US006698614B2

(12) United States Patent
Snead

(10) Patent No.: US 6,698,614 B2
(45) Date of Patent: Mar. 2, 2004

(54) TRANSIT TICKETS WITH FRAGRANCE SAMPLES AND METHOD OF PROMOTING A FRAGRANCE

(76) Inventor: Walter L. Snead, 490 E. Stafford Ave., Suite A, Worthington, OH (US) 43085

( * ) Notice: Subject to any disclaimer, the term of this patent is extended or adjusted under 35 U.S.C. 154(b) by 0 days.

(21) Appl. No.: 10/179,546

(22) Filed: Jun. 25, 2002

(65) Prior Publication Data

US 2002/0158076 A1 Oct. 31, 2002

Related U.S. Application Data

(63) Continuation-in-part of application No. 09/608,483, filed on Jun. 30, 2000.

(51) Int. Cl.[7] ..... B65H 3/58
(52) U.S. Cl. ..... 221/26; 221/135
(58) Field of Search ..... 221/26, 27–70, 221/135; 428/40.1, 43, 321.5, 402.2

(56) References Cited

U.S. PATENT DOCUMENTS 3,494,505 A 2/1970 Huebner
4,661,388 A 4/1987 Charbonneau
5,225,665 A 7/1993 Zerfahs
6,403,186 B1 * 6/2002 Tararuj et al. ..... 428/40.1

FOREIGN PATENT DOCUMENTS

GB 2 296 202 A 11/1994

* cited by examiner

*Primary Examiner*—Kenneth W. Noland
(74) *Attorney, Agent, or Firm*—Porter Wright Morris & Arthur LLP

(57) ABSTRACT

A transit ticket includes a sheet, event indicia on the sheet indicating an event in which the ticket can be utilized, and a product releasing layer on the sheet containing an adhesive and microcapsules with an encapsulated material. The event indicia indicates the transit ticket can be utilized for transportation of the holder on a vehicle of a mass transportation system. The encapsulated material is preferably a fragrance. The transit ticket preferably includes product indicia on the sheet providing information regarding the encapsulated material such as advertisements for the fragrance. A method of promoting a product is also disclosed in which a plurality of tickets are dispensed, each of the tickets having indicia indicating an event for which the ticket can be utilized and a product releasing layer including an adhesive and microcapsules with an encapsulated material.

17 Claims, 3 Drawing Sheets

TRANSIT TICKETS WITH FRAGRANCE SAMPLES AND METHOD OF PROMOTING A FRAGRANCE

CROSS-REFERENCE TO RELATED APPLICATIONS

This application is a Continuation-In-Part Application of U.S. patent application Ser. No. 09/608,483 filed on Jun. 30, 2000.

STATEMENT REGARDING FEDERALLY SPONSORED RESEARCH

Not Applicable

REFERENCE TO MICROFICHE APPENDIX

Not Applicable

FIELD OF THE INVENTION

The present invention relates generally to tickets for an event such as transportation in a mass transit system and, more particularly, to such tickets which contain a microencapsulated releasable substance such as a fragrance.

BACKGROUND OF THE INVENTION

Ruptureable microcapsules containing encapsulated materials have been used for many years in a wide variety of commercial applications. A wide variety of processes exist by which these microcapsules can be manufactured. These uses and methods of manufacture are well known to those skilled in the art.

One well known use of such ruptureable microcapsules is for encapsulating fragrances (i.e. perfumes and colognes) for use in fragrance samplers. These samplers are typically inserted in magazines or handed out at retail establishments by salespeople. One problem with such distribution is that individual samples that are handed out do not reach a large population of potential consumers. Another problem with such distribution is that fragrance samplers in magazines are only received by the limited population of potential consumers who purchase the specific magazine that the fragrance sampler is contained within.

A need exists for a fragrance sampling device that will reach a large amount of people without the need for the potential consumers to purchase a non-necessary or frivolous item such as a magazine.

SUMMARY OF THE INVENTION

The present invention provides a ticket that overcomes at least some of the above-noted problems of the prior art. According to the present invention, a method of promoting a product comprising the steps of providing a plurality of tickets and placing the plurality of tickets in a dispensing device. Each of the tickets has indicia indicating an event for which the ticket can be utilized and a product releasing layer including an adhesive and microcapsules containing an encapsulated material. The tickets are mechanically dispensed from the dispensing device while automatically rupturing the microcapsules to release the encapsulated material. Thus, the encapsulated material has already been released when a person first receives the ticket.

According to another aspect of the present invention, a method of promoting a product includes the steps of providing a plurality of tickets, stacking the tickets to form a stack of the tickets with adjacent tickets adhered together by the product releasing layer, and placing the stack of tickets in a dispensing device. Each of the tickets has indicia indicating an event for which the ticket can be utilized and a product releasing layer including an adhesive and microcapsules containing an encapsulated material. The tickets are mechanically dispensed from the dispensing device while automatically rupturing the microcapsules to release the encapsulated material According to yet another aspect of the present invention, method of promoting a fragrance includes the steps of providing a plurality of transit tickets and placing the plurality of tickets in a dispensing device. Each of the tickets include information permitting travel on a vehicle of a mass transportation system and a product releasing layer having an adhesive layer and microcapsules containing an encapsulated fragrance. Each of the tickets are provided with printed indicia promoting the fragrance. The tickets are mechanically dispensed from the dispensing device while automatically rupturing the microcapsules to release the fragrance.

From the foregoing disclosure and the following more detailed description of various preferred embodiments it will be apparent to those skilled in the art that the present invention provides a significant advance in the technology and art of promoting fragrances. Particularly significant in this regard is the potential the invention affords for providing a high quality, reliable, low cost, wide spread method of promoting a fragrance.

BRIEF DESCRIPTION OF THE DRAWINGS

These and further features of the present invention will be apparent with reference to the following description and drawings, wherein.

It should be understood that the appended drawings are not necessarily to scale, presenting a somewhat simplified representation of various preferred features illustrative of the basic principles of the invention. The specific design features of a ticket as disclosed herein will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF CERTAIN PREFERRED EMBODIMENTS

It will be apparent to those skilled in the art, that is, to those who have knowledge or experience in this area of technology, that many uses and design variations are possible for the ticket and promotion method disclosed herein.

The following detailed discussion of various alternative and preferred embodiments will illustrate the general principles of the invention with reference to a transit ticket for use in a mass transit system. Other embodiments suitable for other applications will be apparent to those skilled in the art given the benefit of this disclosure. The term "ticket" is used herein and in the claims to mean a card, sheet, or item used to gain entrance or participation into an event. The term "event" is used herein and in the claims to mean something that takes place that requires a ticket for participation or entrance such as, for example, transportation like mass transit, sporting events, theatrical or musical performances, movie cinemas, museums, a game of chance like a lottery, amusements, or any other like occurrence. The term "transit ticket" is used herein and in the claims to mean a ticket for use for the event of entrance or passage on a vehicle which is part of a public or private mass transportation system such as a bus, train, tram, or trolley. The term "fragrance" is used herein and in the claims to mean a substance having a pleasant scent such as, for example, perfume, cologne, or any other such scented liquids.

Figure 1:
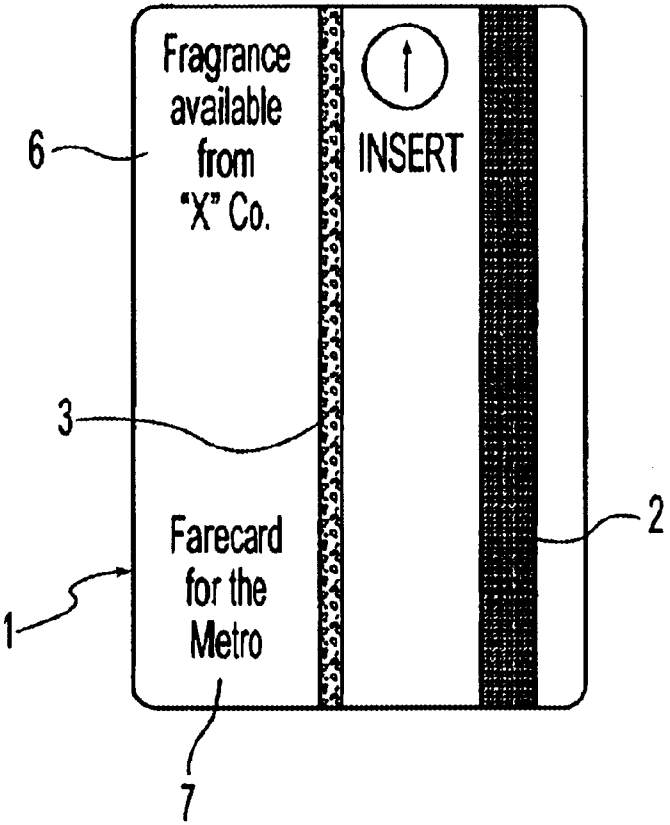
FIG. 1 is a top view of a transit ticket according to the present invention.

As illustrated in FIG. 1, a transit ticket, card, or sheet 1 is provided that contains a magnetic strip 2, a product releasing layer or strip 3, advertising, marketing, or product indicia 6, and event indicia 7. While the illustrated embodiments of the present invention are particularly adapted for use as a transit ticket, it is noted that the present invention can be utilized with any other type of ticket. The illustrated transit ticket 1 is generally rectangular shaped but other shapes can be utilized. The rectangular transit ticket 1 has a width, a length greater than the width, and a thickness substantially less than either the width or length. The transit ticket 1 is designed to move in a longitudinal direction, that is in a lengthwise direction, in dispensing and/or processing devices as discussed in more detail hereinafter.

Referring to FIG. 1, the transit ticket 1 is provided with the magnetic strip 2 to form a data card. The illustrated magnetic strip 2 extends parallel to and displaced from a central longitudinal axis extending along the length of the transit ticket 1. The strip is preferably near one longitudinal edge of the transit ticket. The magnetic strip 2 is made of a magnetic recording material that is capable of being magnetically encoded. The magnet strip is of the type which can be passed through a write head to encode information thereon such as, for example, the value of the transit ticket 1 and passed through a read head to obtain information stored threreon.

The transit ticket 1 is also provided with the product releasing strip 3 which includes material-containing rupture-able microcapsules 8 dispersed in a layer of binder or adhesive material. The ruptureable microcapsules contain an encapsulated material within shells which is dispensed or released when the shells are ruptured. In the preferred embodiment, the ruptureable microcapsules 8 contain an encapsulated fragrance. In the preferred embodiment of the invention, the adhesive material 9 is a pressure-sensitive adhesive material 9. The adhesive material 9 forms a bond with the surface of the ticket 1 which is stronger than the bond formed with the microcapsules dispersed therein. The microcapsules 8 are sized such that cohesive failure of the adhesive material 9 results in breakage or rupture of the microcapsules 8.

The product releasing strip 3 is preferably a strip, but may be present in other forms. The illustrated product releasing strip 3 extends parallel to and at or near the central longitudinal axis of the transit ticket 1. Formed in this manner, the product releasing strip 3 is parallel to and spaced apart from the magnetic strip 2 so that it does not interfere with operation of the magnetic strip 2. Formed in this manner, the product releasing strip 3 adheres to the adjacent ticket 1 along the longitudinal axis but not on either side thereof so that each of the longitudinal edges of the tickets 1 are free of adhesion by the product releasing strip 3.

Figure 2:
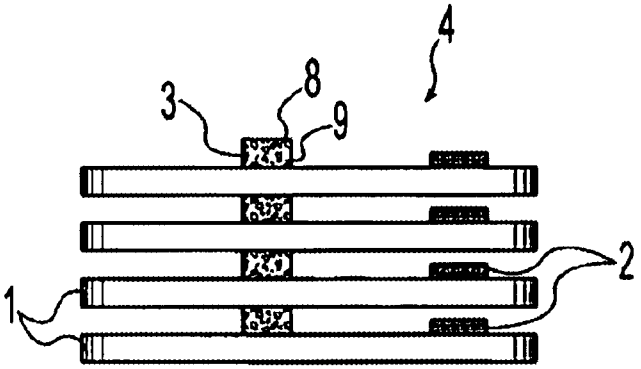
FIG. 2 is a side view of a stacked array of transit tickets according to the present invention.
Figure 3:
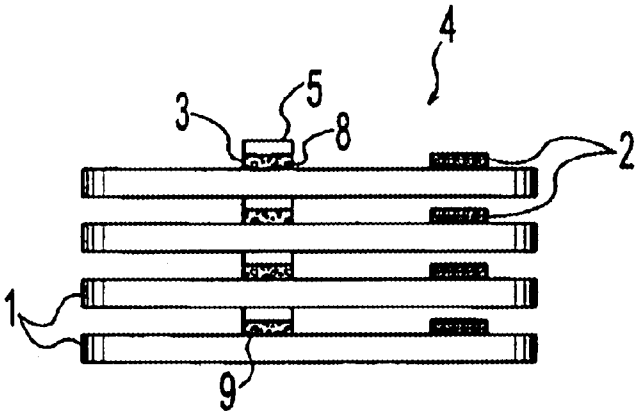
FIG. 3 is a side view of an alternate embodiment of a stacked array of transit tickets according to the present invention.

The product releasing strip 3 may be designed in multiple ways to achieve the same function. As illustrated in FIG. 2, the material of the strip 3 may be a single layer of adhesive material that contains the ruptureable microcapsules 8 within the adhesive material 9. The product releasing strip 3 may alternatively comprise a layer of binder material that contains the ruptureable microcapsules 8 and a separate layer of adhesive material in contact with the layer of binder material. The strip 3 may also alternatively comprise a first layer adhesive material adhered to the surface of the transit ticket 1, a binder material that contains the ruptureable microcapsules 8 adhered to the first layer of adhesive, and an outer layer of adhesive material adhered to the layer of binder material opposite the first layer of adhesive. As best illustrated in FIG. 3, when the product releasing strip 3 includes a layer of adhesive material 9, the product releasing strip 3 may be covered by a cover layer or sheet 5 to keep the adhesive material 9 from adhering to any other object.

Figure 4:
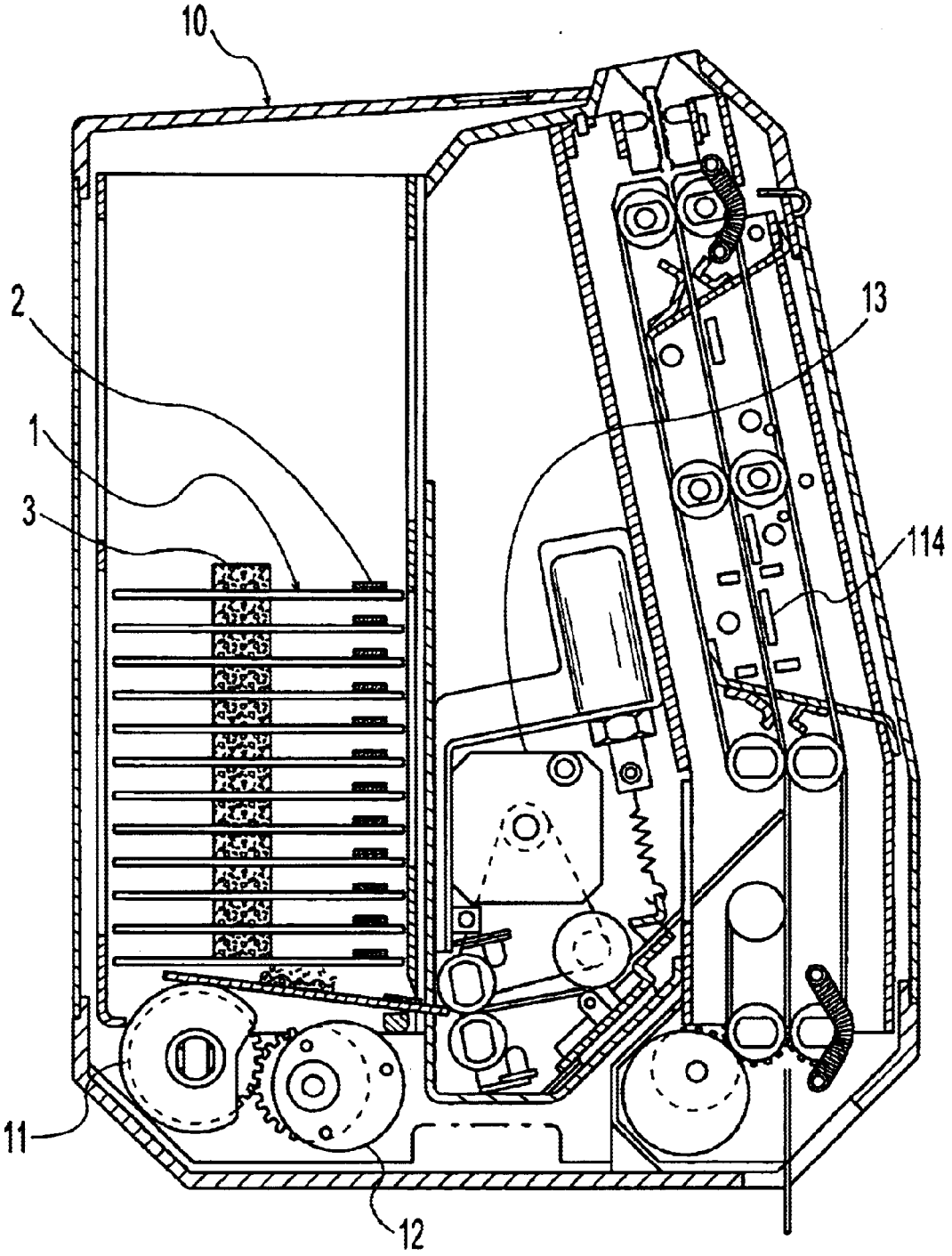
FIG. 4 is a sectional view of a transit ticket dispensing and processing device for dispensing the stacked array of transit tickets according to the present invention.

The illustrated transit ticket 1 also includes a design, logo, slogan, trademark, or other advertising, marketing or product indicia 6 to enhance the effectiveness of the product sample contained in the microcapsules 8 as an advertising or marketing tool. The product indicia 6 can identify, for example, the product contained in the ruptureable microcapsules, the manufacturer of the product, the supplier or distributor of the product, and/or a retailer of the product. In the illustrated embodiment, the product indicia 6 includes the printed words "Fragrance available from X Co." Preferably, the product indicia 6 is preprinted onto the surface of the transit ticket 1 but can alternatively be printed or partially printed by a ticket processing or dispensing device 10 (FIG. 4).

Also provided on the transit ticket 1 is the event indicia 7 indicating use of the transit ticket 1, the information regarding the event for which the transit ticket 1 can be utilized. The event indicia 7 may refer to such events and uses of ticket 1 as for a mass transit system, a concert, a sporting event, or other event. In the illustrated embodiment, the event indicia 7 includes the printed words "Farecard for the Metro." Preferably, the event indicia 7 is preprinted onto the surface of the transit ticket 1 but can alternatively be printed or partially printed by a ticket processing or dispensing device 10 (FIG. 4).

As shown in FIG. 2, multiple transit tickets 1 can be arranged together to form a stack or stacked array of tickets 4. Each transit ticket 1 contains the magnetic strip 2 and the product releasing strip 3 of a material containing ruptureable microcapsules 8 with an encapsulated material within the ruptureable microcapsules 8. Each transit ticket 1 in the stack of tickets 4 is adhered to the next adjacent transit ticket 1 by the product releasing strip 3, the product releasing strip 3 being made from an adhesive material 9 or including an outer adhesive layer.

FIG. 3 illustrates an alternative embodiment of the invention in which the transit tickets 1 are not adhered together in the stack of tickets 4. In this embodiment of the invention, the product releasing strip 3 is still made of an adhesive material 9 (or includes an outer adhesive layer), but the strip 3 is covered by and adhered to the cover sheet 5. This design prevents each transit ticket 1 from adhering to anything else and prevents the product releasing strip 3 containing the ruptureable microcapsules 8 from being exposed to any other material such as the adjacent transit ticket 1. The product indicia 6 is preferably provided on the ticket 1, but can be provided on the cover sheet 5.

Although the specific embodiments of a single ticket and a stack of tickets are described herein, it will be appreciated by one skilled in the art that other variations of the invention, such as tickets in the form of a roll, suitable for particular events and methods of distribution are included in the present invention.

As discussed in U.S. Pat. No. 5,225,665 of Zerfahs et al. entitled TICKET ORIGINATING AND PROCESSING DEVICE FOR TRANSIT VEHICLE and in U.S. Pat. No. 4,376,942 of Toth et al. entitled THERMAL PRINTING SYSTEM, the tickets may also contain a heat sensitive coating to respond to a thermal dot matrix printer contained in a ticket processing or dispensing device.

In general, the transit ticket 1 according to the present invention is designed so that the encapsulated material contained in the ruptureable microcapsules 8 of product releasing strip 3 is released when the microcapsules 8 are ruptured. As discussed in U.S. Pat. No. 4,661,388 of Charbonneau entitled PAD FRAGRANCE SAMPLING DEVICE, hereby expressly incorporated herein in its entirety by reference, and as well known in the art, there are many manufacturing processes of microcapsules containing microencapsulated materials. In the embodiment illustrated in FIG. 2, the transit tickets 1 are designed so that the microcapsules 8 contained the product releasing strips 3 on the tickets 1 are ruptured when the transit tickets 1 are separated from one another, thereby dispersing the material contained in the ruptureable microcapsules 8 of the transit ticket 1 removed from the stack 4. In the embodiment illustrated in FIG. 3, the transit tickets 1 are designed so that the ruptureable microcapsules 8 contained on the transit ticket 1 are ruptured when the cover sheet 5 is removed from the product releasing strip 3 containing the ruptureable microcapsules 8, thereby dispersing the material in the ruptureable microcapsules 8 of the transit ticket 1. It will be appreciated from the aforementioned U.S. Pat. No. 4,661,388, and other prior art, that the design of such rutureable microcapsules 8 contained within the adhesive material 9 (or other binder material) and the relationships and specifics of the adhesive material 9, ruptureable microcapsules 8, and/or binder material needed to ensure disbursement of the microencapsulated substance at the desired time are well known within the prior art. Therefore, such a design can be readily implemented by one skilled in the art given the benefit of this disclosure.

The alternative embodiment illustrated in FIG. 3 may also be designed such that the sheet 5 may be reapplied to the product releasing strip 3 containing the ruptureable microcapsules 8 to allow a user to sample the fragrance and then avoid, or at least partially avoid, further exposure to the fragrance. This feature may be incorporated into the present invention using the disclosure of U.S. Pat. No. 5,611,972 of Tararuj et al. entitled DEVICES AND RELATED METHOD FOR THE SELECTIVE EXPOSURE OF MICROENCAPSULATED LIQUIDS, hereby expressly incorporated herein in its entirety by reference. Such a design would allow a potential purchaser to sample a product while viewing the advertisement and, after sampling the product, continue using the ticket without further exposure to the fragrance. In this design, only a portion of the ruptureable microcapsules 8 are broken after the sheet 5 is separated from the product releasing strip 3. Because some of the ruptureable microcapsules 8 remain intact, the potential purchaser would also be able to resample the fragrance at a later time by once again removing the sheet 5 from the product releasing strip 3.

Figure 5:
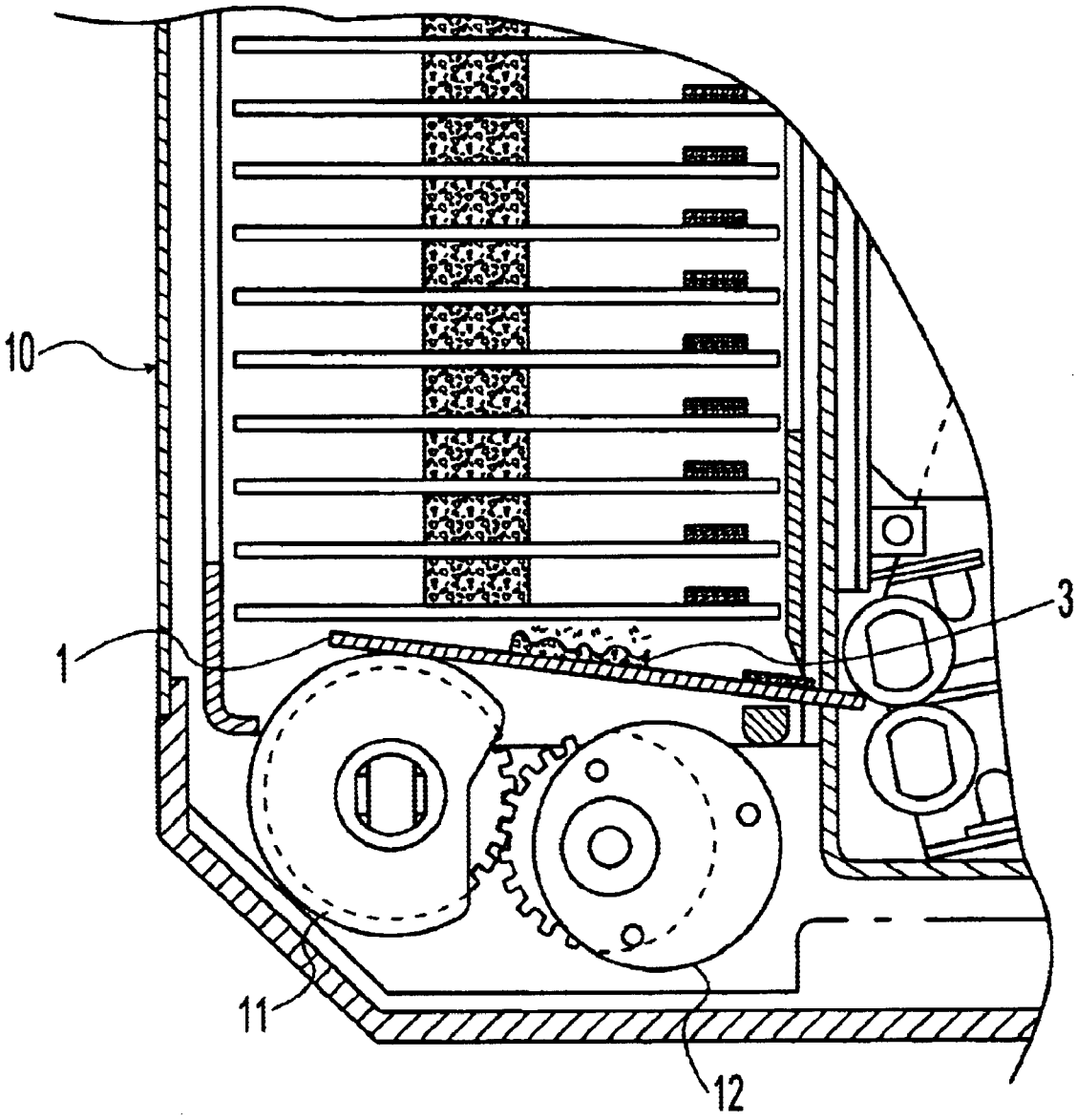
FIG. 5 is an enlarged, fragmented view showing a portion of the transit ticket dispensing and processing device of FIG. 4 in the area where one of the transit tickets is removed from the bottom of the stacked array of tickets.

The transit tickets 1 according to present invention are preferably designed to be compatible with existing transit ticket dispensing and processing machines such that little or no modification of those machines are needed in order to use the transit tickets 1 therewith. FIG. 4 illustrates a transit ticket dispensing device 10 which is substantially the same as the transit ticket dispenser described in U.S. Pat. No. 5,225,665 of Zerfahs et al. entitled TICKET ORIGINATING AND PROCESSING DEVICE FOR TRANSIT VEHICLE, the disclosure of which is expressly incorporated herein in its entirety by reference, except that the device dispenses transit tickets 1 according to the present invention rather than conventional tickets. The transit tickets 1 are dispensed from the stack of tickets 4 which are connected by the product releasing strips 3. The transit tickets 1 are preprinted with the product indicia 6 and the event indicia 7. When a transit ticket is to be dispensed from the device 10, the bottom transit ticket 1 on the stack of tickets 4 is engaged by a feed wheel 11 which is selectively rotated by a motor 12. The rotating feed wheel 11 overcomes the adherence of the product releasing strip 3 and advances the transit ticket away from the stack of tickets 4 in order to expel the bottom transit ticket 1 from the stack of transit tickets 4. To advance the transit ticket 1, the wheel 11 must overcome the cohesive strength of the product releasing layer whereby the microcapsules are ruptured or broken and the product contained therein released (best shown in FIG. 5). The transit ticket 1 is advanced toward a thermal dot matrix printer 13 which prints additional indicia thereon such as, for example, a value of the transit ticket 1 and then toward a magnetic write head 14 for encoding the magnetic strip 2 with information such as, for example, a value of the transit ticket 1.

The transit ticket 1 emerges from the device 10 into the hands of a potential consumer with the ruptureable microcapsules 8 already broken and the product dispensed. When the product is a fragrance, the transit ticket 1 is dispensed with the fragrance released from at least some of the ruptureable microcapsules 8 so that the fragrance is immediately apparent the person receiving the transit ticket 1 and attention is drawn to the product indicia 6 printed on the transit ticket 1. Thus, both the fragrance and the advertisement indicia 6 on the transit ticket 1 are perceptible to the potential consumer immediately upon receiving the dispensing of the transit ticket 1. It is apparent from the above description that the ruptureable microcapsules 8 are automatically ruptured by mechanical action of the device 10 so that no action by the person receiving the ticket is required to rupture the ruptureable microcapsules 8. If the microcapsules are not automatically ruptured, the potential customer may not rupture the ruptureable microcapsules 8 and/or may not notice the product indicia 6.

The feed wheel 11 of the device 10 provides the force needed to separate the bottom transit ticket 1 and the adhesive material 9 of the product releasing strip 3 from the transit ticket 1 immediately above it. As described above, this separation of the transit tickets 1 ruptures at least some of the microcapsules 8 and released the microencapsulated fragrance contained therein. The feed wheel 11 and the motor 12 must provide adequate force to overcome the cohesive strength of the product releasing layer 3. Preferably, the product releasing layer 3 is adapted to be broken by feed wheels 11 of conventional dispensing devices. The product releasing layer 3 should have a cohesive strength which can be broken by the force of the feed wheel 11 to rupture at least some of the microcapsules while substantially maintaining the bond to the surface of the transit ticket. The product releasing layer 3 preferably a thickness small enough to permit passage of the transit ticket 1 through the remainder of the device 10. This can be achieved by proper adhesive and/or binder material selection and/or by proper selection of the size, shape and orientation of the product releasing strip 3. It is believed that the illustrated narrow strip extending centrally along the length of the transit ticket 1, that is in the direction of motion and at the center of the feed wheel, provides desirable results.

The alternative embodiment shown in FIG. 3 can also be designed to be compatible with the device 10. As the embodiment illustrated in FIG. 3 is a stack of tickets 4 that are not adhered together in any manner, the aforementioned dispensing and processing device would function in the same manner as described above except that, when the ticket 1 is dispensed, the ticket 1 contains the advertisement indicia 6 as well as the product releasing strip 3 covered by the cover sheet 5. If desired (and perhaps prompted by a designation on the ticket 1), the potential consumer can remove the cover sheet 5 from the strip 3 in order to rupture the ruptureable microcapsules 8 and release the fragrance contained therein. As discussed above, the tickets illustrated in FIG. 3 may be designed in accordance with U.S. Pat. No. 5,611,972 in order to allow a person to sample the fragrance and then reapply the sheet 5 to avoid (or partially avoid) further exposure to the fragrance and re-sample the fragrance at a later time.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the invention discussed herein in connection with a transit ticket can be utilized with other types of tickets. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A method of promoting a product comprising the steps of:

providing a plurality of tickets, each of the tickets having indicia indicating an event for which the ticket can be utilized and a product releasing layer including an adhesive and microcapsules containing an encapsulated material;

placing the plurality of tickets in a dispensing device;

mechanically dispensing the tickets from the dispensing device while automatically rupturing the microcapsules to release the encapsulated material; and wherein the step of providing the plurality of tickets includes providing a stack of the tickets.

2. A method according to claim 1, wherein the step of providing the plurality of tickets includes providing a stack of the tickets with adjacent tickets adhered together by the product releasing layer.

3. The method according to claim 1, wherein the step of providing the plurality of tickets includes providing each of said tickets with the product releasing layer including microcapsules containing a fragrance.

4. A method of promoting a product comprising the steps of:

providing a plurality of tickets, each of the tickets having indicia indicating an event for which the ticket can be utilized and a product releasing layer including an adhesive and microcapsules containing an encapsulated material;

placing the plurality of tickets in a dispensing device;

mechanically dispensing the tickets from the dispensing device while automatically rupturing the microcapsules to release the encapsulated material; and wherein the step of mechanically dispensing the tickets includes engaging one of the tickets with a motorized wheel.

5. A method of promoting a product comprising the steps of:

providing a plurality of tickets, each of the tickets having indicia indicating an event for which the ticket can be utilized and a product releasing layer including an adhesive and microcapsules containing an encapsulated material;

placing the plurality of tickets in a dispensing device;

mechanically dispensing the tickets from the dispensing device while automatically rupturing the microcapsules to release the encapsulated material; and providing each of the tickets with printed indicia promoting the product.

6. A method of promoting a product comprising the steps of:

providing a plurality of tickets, each of the tickets having indicia indicating an event for which the ticket can be utilized and a product releasing layer including an adhesive and microcapsules containing an encapsulated material;

placing the plurality of tickets in a dispensing device;

mechanically dispensing the tickets from the dispensing device while automatically rupturing the microcapsules to release the encapsulated material;

wherein the step of providing the plurality of tickets includes providing each of said tickets with the product releasing layer including microcapsules containing a fragrance; and providing each of the tickets with printed indicia promoting the fragrance.

7. A method of promoting a product comprising the steps of:

providing a plurality of tickets, each of the tickets having indicia indicating an event for which the ticket can be utilized and a product releasing layer including an adhesive and microcapsules containing an encapsulated material;

placing the plurality of tickets in a dispensing device;

mechanically dispensing the tickets from the dispensing device while automatically rupturing the microcapsules to release the encapsulated material; and wherein the step of providing the plurality of tickets includes providing a plurality of transit tickets each permitting travel on a vehicle of a mass transportation system.

8. A method of promoting a product comprising the steps of:

providing a plurality of tickets, each of the tickets having indicia indicating an event for which the ticket can be utilized and a product releasing layer including an adhesive and microcapsules containing an encapsulated material;

stacking the tickets to form a stack of the tickets with adjacent tickets adhered together by the product releasing layer;

placing the stack of tickets in a dispensing device; and mechanically dispensing the tickets from the dispensing device while automatically rupturing the microcapsules to release the encapsulated material.

9. The method according to claim 8, wherein the step of mechanically dispensing the tickets includes engaging one of the tickets with a motorized wheel.

10. The method according to claim 8, further comprising the step of providing each of the tickets with printed indicia promoting the product.

11. The method according to claim 8, wherein the step of providing the plurality of tickets includes providing each of said tickets with the product releasing layer including microcapsules containing a fragrance.

12. The method according to claim 11, further comprising the step of providing each of the tickets with printed indicia promoting the fragrance.

13. The method according to claim 8, wherein the step of providing the plurality of tickets includes providing a plurality of transit tickets each permitting travel on a vehicle of a mass transportation system.

14. A method of promoting a fragrance comprising the steps of:

providing a plurality of transit tickets, each of the tickets including information permitting travel on a vehicle of a mass transportation system and a product releasing layer including an adhesive and microcapsules containing an encapsulated fragrance;

providing each of the tickets with printed indicia promoting the fragrance;

placing the plurality of tickets in a dispensing device; and mechanically dispensing the tickets from the dispensing device while automatically rupturing the microcapsules to release the fragrance.

15. The method according to claim 14, wherein the step of mechanically dispensing the transit tickets includes engaging one of the transit tickets with a motorized wheel.

16. The method according to claim 14, wherein the step of providing the plurality of transit tickets includes providing a stack of the transit tickets.

17. The method according to claim 16, wherein the step of providing the plurality of transit tickets includes providing a stack of the transit tickets with adjacent transit tickets adhered together by the product releasing layer.

* * * * *